United States Patent [19]

Brosseau et al.

[11] 4,138,923

[45] Feb. 13, 1979

[54] DRUM CARTRIDGE - MAGAZINE

[75] Inventors: Timothy L. Brosseau; Arthur Liberatore, both of Havre de Grace, Md.

[73] Assignee: The United States of America as represented by the Secretary of the Army, Washington, D.C.

[21] Appl. No.: 811,111

[22] Filed: Jun. 29, 1977

[51] Int. Cl.[2] ..... F41C 25/10

[52] U.S. Cl. ..... 89/33 D

[58] Field of Search ..... 42/6, 50; 89/33 D, 33 B, 89/33 BA

[56] References Cited

U.S. PATENT DOCUMENTS

| | | | |
|---|---|---|---|
| 290,622 | 12/1883 | Accles | 89/33 D |
| 1,361,402 | 12/1920 | Payne | 89/33 D |
| 2,394,606 | 2/1946 | Gazda | 89/33 D |

FOREIGN PATENT DOCUMENTS

| | | | |
|---|---|---|---|
| 885432 | 9/1943 | France | 89/33 D |

*Primary Examiner*—Stephen C. Bentley

*Attorney, Agent, or Firm*—Nathan Edelberg; Harold H. Card, Jr.; A. Victor Erkkila

[57] ABSTRACT

A cartridge magazine including a spiral channel having a tangential linear exit section, a plurality of spider arms dividing the cartridges into groups of cartridges and having a plurality of indentures in their radial faces, and a drive means mounted external to the magazine for driving said arms. The spiral is a perfect Archimedian spiral and the indentures on an arm number one less than the number of cartridges in a group and are displaced radially by the diameter of a cartridge.

4 Claims, 5 Drawing Figures

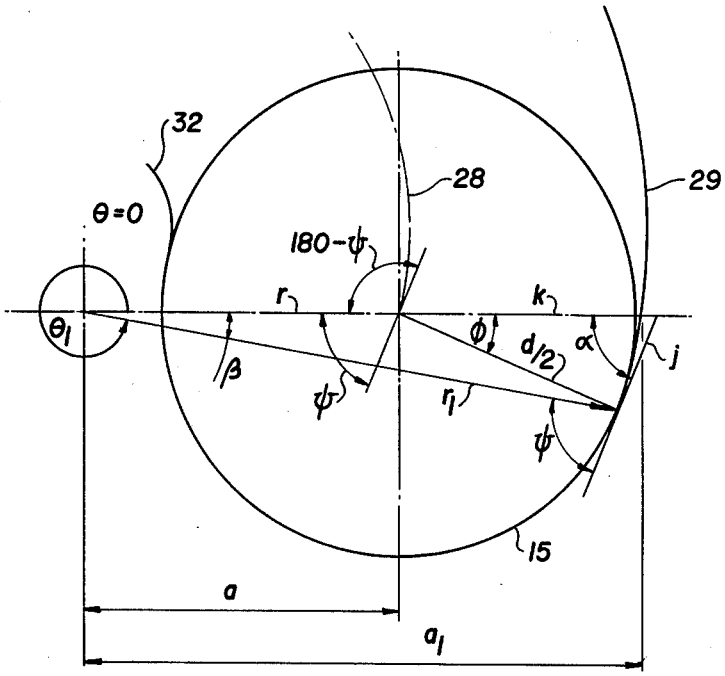
FIG.3
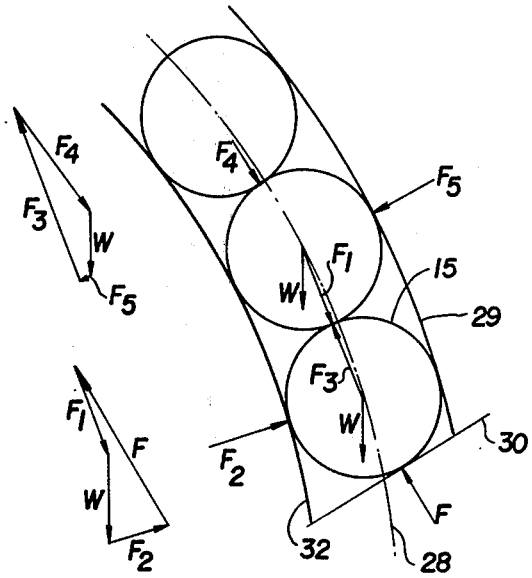
FIG.4
FIG.5
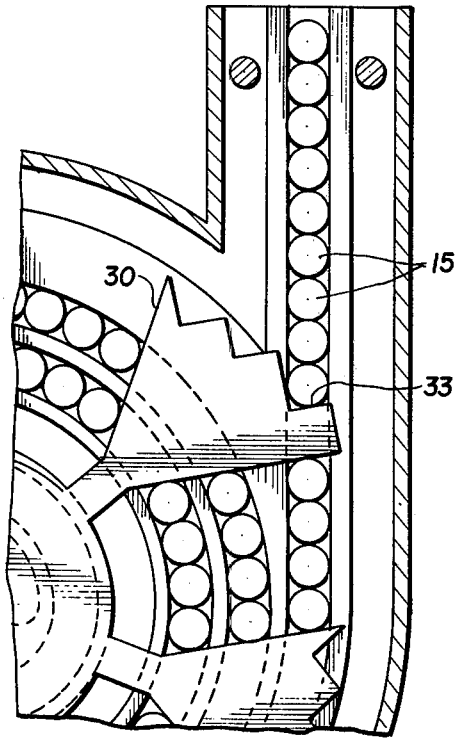

DRUM CARTRIDGE - MAGAZINE

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention relates to a mechanically operated cartridge magazine for use with automatic weapons.

The history of weapon feed mechanisms include hand loading, internally and externally powered devices and the various combinations of round configurations and assembly. However, in regard to the present invention, i.e., a stored energy cylindrical drum feed mechanism for portable weapons, the availability of the devices is limited and of these limited devices, performance has been erratic and unreliable. F. A. Hobart on pages 22 and 23 of "Pictorial History of Submachine Guns" (Charles Scribner's Sons, New York, 1973) catalogued some of these weapons.

Maxim determined that a flat drum feed was impractical for sustained fire; Carr, with a high capacity drum, encountered power consumption difficulties; and the Lewis gun, with a flat rather than cylindrical disposition of the cartridge, was eminently successful as reported on pages 131, 226, and 280, respectively of "The Machine Gun", Vol. 1, McChin, George, Superintendent of Documents, U.S. Government Printing Office, Washington, D.C.

U.S. patents which generally show the state of the art of drum magazines having approximately spiral internal configurations are as follows:

U.S. Pat. No. 290,622
U.S. Pat. No. 1,347,755
U.S. Pat. No. 1,361,402
U.S. Pat. No. 1,596,178
U.S. Pat. No. 2,394,606
U.S. Pat. No. 2,596,293

The problems with the prior art are explicitly spelled out in these patents, namely, the unevenness of drive pressure using a single rear-most arm on the cartridges, which also results in binding of the cartridges against the exterior guide walls, and the inability of spring mechanisms to exert sufficient pressure to accelerate and feed the cartridges within the time allowable during the excess breach block travel and the subsequent opening of the feeding aperture. Solutions of these problems have included using circular and non-spiral guide configurations, a second loading spring to bias the cartridge to the breach, and larger non-spring type of driving mechanisms. These solutions have not proved practical for the high speed weapons presently used.

Thus there exists the need for a drum cartridge magazine which resolves the problems of parasitic power consumption due to component loading manifested as friction between adjacent cartridges and between the cartridges and container, to provide reliable and high capacity, high speed cartridge feed.

2. Summary of the Invention

The present invention is a drum or cylindrical shaped cartridge magazine used with high speed weapons wherein a perfect spiral channel terminates in a tangentially linear exit section. A plurality of spider arms extending radially from a hub divide the cartridges into a plurality of groups of cartridges. An externally mounted torsion spring drives these spiders through the hub so as to bias and feed the cartridges from the spiral to the exit section. The spiral being a perfect Archimedian spiral defined by the equation $r=K\theta+a$ for the centerline of the channels on each opposing face of the housing. The walls of the channels differ or vary from the centerline by an amount defined by the radius of the nose and base of the cartridge respectively, such that the axis of the cartridge is parallel to the axis of the hub. The radial faces of the arms of the spider includes a plurality of indentures for engaging and driving the cartridges in the linear exit section. The radial distance of the indentures from the center of rotation increase radially by the diameter of the cartridge. The number of indentures in the radial face of an arm is one less than the number of cartridges in a group. Thus for four cartridges to a group, there are three indentures in the radial face of an arm. The lateral faces of the arms diverge radially so as to continuously engage the leading and trailing cartridge as the cartridge traverses the spiral channel by defining a constant circumferal distance between the lateral faces at all radial points.

OBJECTS OF THE INVENTION

An object of the present invention is to provide drum cartridge magazines capable of operating with high speed automatic weapons.

Another object is to provide an Archimedian spiral cartridge magazine for use with high speed weapons.

A further object of the invention is to reduce parasitic power consumption due to component loading.

Still another object is to provide a drum cartridge magazine which maintains individual control over the cartridges and provides reliable high capacity drum feed.

Still even a further object of the present invention is to provide a smooth, accurate, high speed feed of cartridge from the magazine using a single source of stored energy drive through delivery.

Other objects, advantages, and novel features of the present invention will become apparent from the following detailed description of the invention when considered in conjunction with the accompanying drawings.

BRIEF DESCRIPTION OF THE DRAWINGS

FIG. 3 is an expanded scale of the geometric relationship of the cartridge and the spiral channel.

FIG. 4 is an expanded diagramatic illustration of the forces on a group of cartridges.

FIG. 5 is a partial view illustrating the spider arm in a rotated position relative to FIG. 1.

DESCRIPTION OF THE PREFERRED EMBODIMENTS

Figure 2:
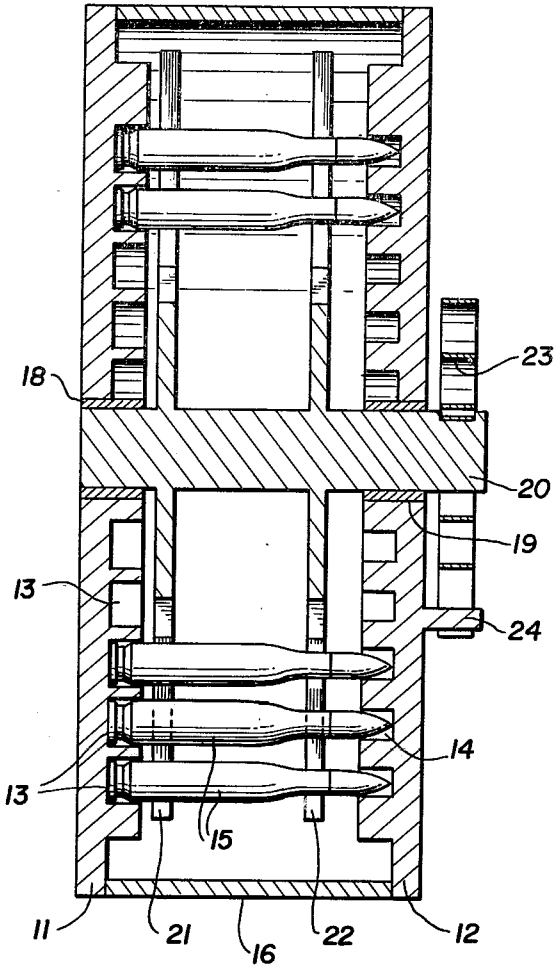
FIG. 2 is a side cross-sectional view taken along lines 2—2 of FIG. 1.
Figure 1:
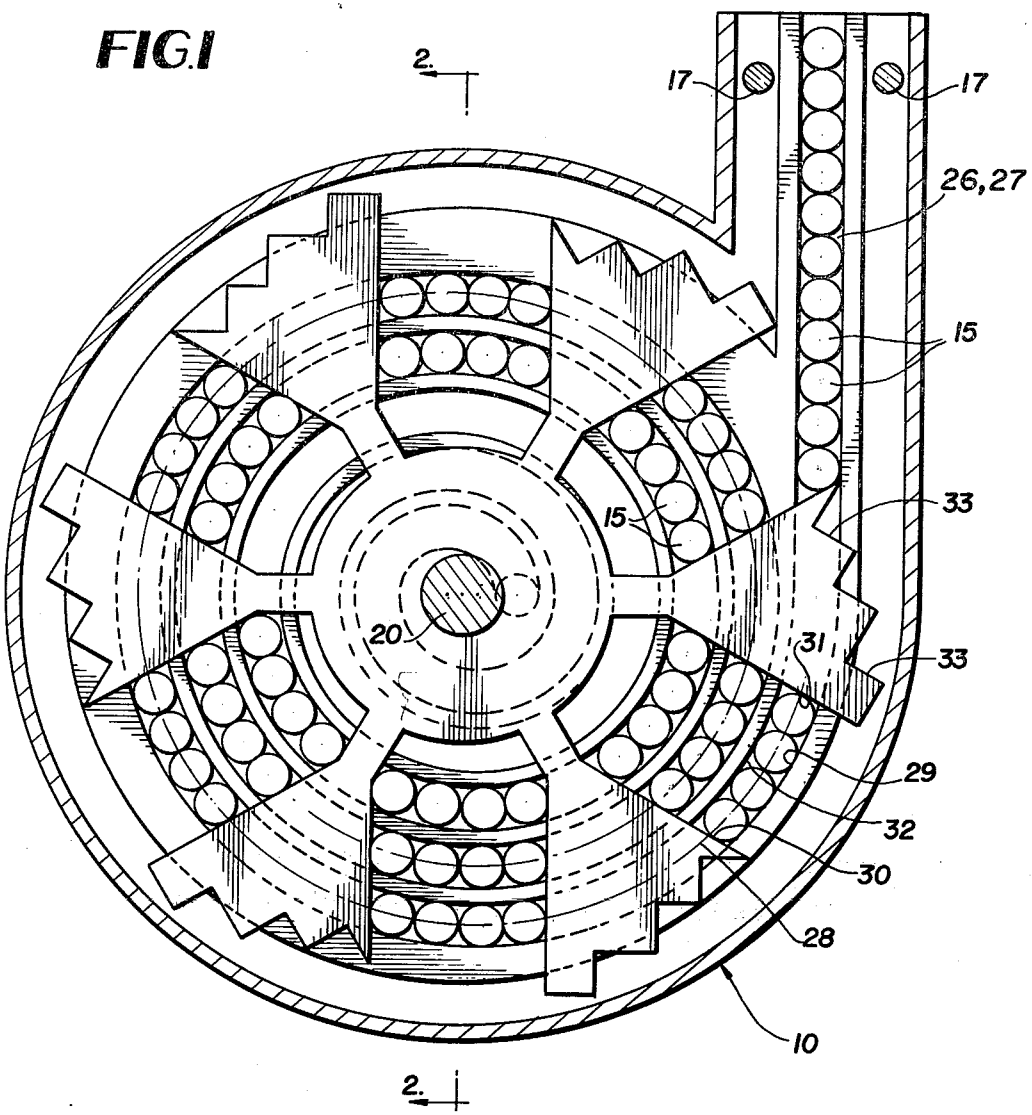
FIG. 1 is an end cross-sectional view of a drum cartridge magazine according to the present invention.

As illustrated in FIGS. 1 and 2, the drum or cylindrical magazine 10 consists of opposed end plates 11 and 12 whose interior walls are spirally indented to form tracks or channels 13 and 14 which act to guide the nose and base of cartridge 15 respectively. A weathertight cover or side wall 16 is attached between the end plates 11 and 12 by means of suitably located fasteners 17 or other similar devices. Each end plate contains a line bearing 18 and 19 located to accommodate shaft or hub 20 on which are positioned the base spider arms 21 and the nose spider arms 22. The spiders 21, 22 are driven by spring 23 which is a commercially available torsion spring so wound as to produce an effectively constant resisting force during extension. Spring 23 is externally mounted and biased tightly against post 24 of the end plate 11 or 12 and is secured to shaft 20 to rotate the assembly of shaft 20 and spiders 21 and 22.

The cartridges 15 are shown positioned within the drum 10 with axis essentially parallel to the axis of shaft 20 and constrained by the spiders 21 and 22. A plurality of groups of four cartridges are defined by the separation between the individual arms of spiders 21 and 22.

As driven by the spiders and guided by the channels, the cartridges are progressively moved into channels 26 and 27 which are formed as integral straight or linear tangential extensions of channels 13 and 14 and end plates 11 and 12. The extreme extension of channels 26 and 27 position the cartridges for stripping off from the magazine by the bolt carrier motion.

An alternate construction would employ a cantilever mounting of the shaft 20 and combine one side plate 12, for instance, with a deep cylindrical cover for purposes of convenience and economy.

The theoretical centerline path 28 of the spiral tracks 13 and 14 in end plates 11, 12 is defined as a segment of an Archimedian spiral of mathematical definition:

$$r = K\theta + a$$

where, in polar coordinates:

r = radius from origin to any point on the centerline
$\theta$ = polar angle to this point
K = proportioning coefficient
a = initial offset from origin.

FIG. 3 illustrates in expanded scale the relation between the cylindrical cartridge 15, the spiral path of the centerline 28, and the path of the outer wall 29 of the channel for the base of the cartridge. This spiral path 29 must also take the form $$r_1 = K_1\theta_1 + a_1$$

where, in polar coordinates:

$r_1$ = radius from origin to any point on the outer wall
$\theta_1$ = polar angle to this point
$K_1$ = proportioning coefficient
$a_1$ = initial offset from origin.

The path 28 and the path 29 are related by the requirement that the tangent to 29 always be perpendicular to the circle representing the cartridge periphery whose center is always on 28. This provides a numerical solution to the obtuse triangle formed by r, $r_1$, and d/2 where d/2 is the radius of the cartridge circle, as shown in FIG. 3. At r, $\theta$, the tangent to 28 is determined from $\tan \Psi = r(d/dr)$ where $\Psi$ is the angle between r and the tangent line.

$$\Psi = \arctan [r(d\theta/dr)]$$

By definition, the perpendicular to the tangent at the point of tangency will be the radius of the cartridge circle which will be also perpendicular to the tangent line of the cartridge circle at its periphery; i.e., at a point where the periphery of the cartridge circle contains curve 29. By one of several solutions:

$$\cos \phi = d/2k;$$

$$\sin \phi = j/k;$$

and $$k = (d/2 \cos \phi);$$

where $\phi$, j and k are defined in FIG. 3. Since $$\Psi = a = \arctan [r(d\theta/dr)]$$

$$J = (d/2r)(dr/d\theta)$$

$$k = d/2\,[1 + (1/r)(dr/d\theta)^2]^{\frac{1}{2}}.$$

$r_1^2$ can be calculated from $r_1^2 = (r+k)^2 + j^2 - 2(r+k)j \cos \alpha$ whereby, with $r = 0.0696\theta + 0.250$ and $d = 0.375$, $r_1 = 0.435$ in. But, $r_1 = k_1\theta_1 + a_1$ defines the outer wall. So, from FIG. 3, at $\theta = 0$ $$\theta_1 = \theta - \beta = -6.71^\circ$$

$$a_1 = r_1 - K_1\theta_1 = 0.435 - (0.0696)(-0.117) = 0.433 \text{ in.}$$

and $r_1 = 0.0696\theta_1 = 0.443$ in.

Guidance of the nose section by the corresponding opposite wall track will be guaranteed by the same reasoning but will have a definition of the wall of that spiral as determined by the diameter of the nose at the contact point.

A second geometric relationship which is important to the present invention is the lateral faces 30 and 31 of the arms of the spider 21 and 22 which engage the leading and trailing cartridge of the four cartridge group. Any curve face 30, which provides a continuous surface over the span from the inner to the outer channel such that the point of contact with the cartridge is maintained will satisfy the design requirement. An infinite number of curves will do this and, for manufacturing simplicity, a bilinear development along faces 30 and 31 is elected. The tangent to the cartridge case, in cartesian form, for $\theta = 0$ is $y = 0.15$ in., for 1.3 in $< r < 1.6$ in., and for the outer section is $y = 0.557x - 0.75$ in. The reverse face 31 of the spider forms a compartment of constant width. The face 30 and 31 diverge radially to provide the constant circumferal width.

The relationship of the design of spiral channels and the lateral faces of the spider arms are best illustrated by the resulting forces on the cartridges. FIG. 4 illustrates the initial forces as statically disposed on the cartridge which bears on the leading contact face 30 of the spider arm 21. From the previous geometric discussion, it is obvious that adjacent cylindrical cartridges 15 will contact at their radii locating a point interior to the centerline of motion 28 and producing resisting force $F_1$ directed radially through the cartridge center of gravity. Application of F from face 30 of spiders exterior to the centerline path 28 will thus produce a resultant force which will be disposed at the inner wall 32 as reaction $F_2$. Since the three remaining cartridges in this group will contact at their periphery and the contact point will always be interior to path 28, these cartridges will bear against the outer wall 29 in the first and third quadrants. In the second and fourth quadrants the disposition will be reversed. $F_3$, $F_4$, and $F_5$ indicate corresponding forces on these cartridges.

The friction forces will oppose the direction of local motion but, due to the small contact area and the small unitized loading from forward cartridges, they will be of negligible magnitude. The accelerating forces never exceed three "g" along path 28 and are also negligible for strength determinations.

Each four-cartridge group is impelled as a unit along the channel to the straight exit channel 26, 27. As the single cartridge at the top is stripped from the string by the forward motion of the bolt (not shown), the shaft 20 and spider arms 21, 22, under the torque produced by the spring 23 can index forward the equivalent of one cartridge rotation. The contact faces 30 of the spider at its outer extremity describes a circle which ultimately sweeps past the channel span and ceases contact with the cartridges. Concurrently, the return motion of the bolt—which contains a "pick off" lug—acts on the top cartridge to press down on the string. The reversal of forces and of motion is contained by the progressive steps or indentures 33 machined into the radial face of the spider arms. As each step face exceeds the cartridge contact limiting location, the one following is then in position to contain the cartridge string. The following group of four cartridges is then automatically fed into the string from the spiral channel as the last step face rotates out of contact.

The contact faces of the separate steps are uniformly spaced across the spider periphery and the radial extent of each step is also uniformly graduated at the rate of one cartridge diameter per step. The inner edge of the channel determines the inclination of the radial faces; i.e., the radial faces should align with the inner edge of the channel upon passage. The number of indentures are one less than the number of cartridges in a group. For the illustrated embodiment, three indentures 33 are needed for the four cartridge group. The operation of the indentures is shown in FIG. 5 wherein a cartridge 15 engages the last indenture 33 of spider arm 21.

The spider arm design and configuration constitutes the central element of this invention. A predetermined, uniformly stepped motion is required by the gun operating cycle and is delivered by the self-compensating spring drive in combination with the individual regulation of the cartridges by the stepped outer controur of the spiders at the transition section in the movement of the cartridges from the spiral channel to the straight feed or exit channel.

The preceding description of preferred embodiments is evidence that the objects of the invention are obtained in that a drum cartridge magazine is provided having a uniquely designed channel and spider arm configuration to produce a rapid, continuous and smooth delivery of a plurality of cartridges to an automatic weapon. Although the invention has been described and illustrated in detail, it is to be clearly understood that the same is by way of illustration and example only.

We wish it to be understood that we do not desire to be limited to the exact details of construction shown and described, for obvious modifications can be made by a person skilled in the art.

What is claimed is:

1. A cartridge magazine comprising:

a substantially cylindrical housing having a pair of opposed end walls and a side wall;

a spiral channel terminating in a substantially linear section extending substantially tangentially from the end of the spiral on the interior face of each of said end walls for guiding the nose and base of the cartridge respectively;

spider means interior to said housing having a plurality of arms for dividing the cartridges into a plurality of fixed quantity groups between pairs of said arms, wherein each of said arms includes a plurality of indentures in their radial faces for engaging the cartridges in said linear section; and drive means connected to said spider means for rotating said arms.

2. A cartridge magazine comprising:

a housing;

a substantially spiral channel in said housing terminating in a non-spiral exit section;

spider means interior to said housing having a plurality of arms dividing the cartridges into a plurality of groups between pairs of said arms, the radial face of each of said arms including a plurality of indentures for engaging cartridges in said exit section, said indentures on an arm having progressively increasing radial displacement; and drive means connected to said spider means for rotating said arms.

3. The cartridge magazine according to claim 2 wherein the displacement increases by increments equal to the diameter of the cartridge.

4. A cartridge magazine comprising:

a housing;

a substantially spiral channel in said housing terminating in a non-spiral exit section, wherein said exit section is substantially linear extending tangentially from the end of said spiral;

spider means interior to said housing having a plurality of arms dividing the cartridges into a plurality of groups between pairs of said arms, the radial face of each of said arms including a plurality of indentures for engaging cartridges in said exit section; and drive means connected to said spider means for rotating said arms.

* * * * *